US005850586A

United States Patent [19]

Sugihara et al.

[11] Patent Number: 5,850,586

[45] Date of Patent: Dec. 15, 1998

[54] ROTARY DEVELOPING DEVICE FOR AN IMAGE FORMING APPARATUS

[75] Inventors: Kazuyuki Sugihara; Tomoji Ishikawa, both of Yokohama; Katsuhiro Kosuge, Tokyo, all of Japan

[73] Assignee: Ricoh Company, Ltd., Tokyo, Japan

[21] Appl. No.: 980,339

[22] Filed: Nov. 28, 1997

Related U.S. Application Data

[63] Continuation of Ser. No. 459,423, Jun. 2, 1995, abandoned.

[30] Foreign Application Priority Data

Jun. 5, 1994 [JP] Japan ..... 6-147177

[51] Int. Cl.[6] ..... G03G 15/01

[52] U.S. Cl. ..... 399/227

[58] Field of Search ..... 399/227, 274, 399/284, 256, 264

[56] References Cited

U.S. PATENT DOCUMENTS

| | | | |
|---|---|---|---|
| 4,528,936 | 7/1985 | Shimazaki et al. | 399/284 |
| 4,559,898 | 12/1985 | Fukuchi et al. | 118/53 |
| 4,792,825 | 12/1988 | Saito et al. | 355/245 |
| 4,821,075 | 4/1989 | Saito et al. | 355/209 |
| 4,922,301 | 5/1990 | Katoh et al. | 355/251 |
| 4,975,748 | 12/1990 | Koinuma et al. . | |
| 5,105,226 | 4/1992 | Sugihara et al. . | |
| 5,109,254 | 4/1992 | Oka et al. . | |
| 5,384,628 | 1/1995 | Takami et al. . | |
| 5,416,568 | 5/1995 | Yoshiki et al. . | |
| 5,565,973 | 10/1996 | Fujishiro et al. | 399/227 |
| 5,612,769 | 3/1997 | Sugihara et al. | 399/119 |

FOREIGN PATENT DOCUMENTS

| | | |
|---|---|---|
| 61-217072 | 9/1986 | Japan . |
| 62-109074 | 5/1987 | Japan . |
| 2-309374 | 12/1990 | Japan . |
| 3-37455 | 4/1991 | Japan . |
| 5-346735 | 12/1993 | Japan . |

*Primary Examiner*—William Royer

*Attorney, Agent, or Firm*—Oblon, Spivak, McClelland, Maier & Neustadt, P.C.

[57] ABSTRACT

In an image forming apparatus, a rotary developing device has a developing unit in which a plurality of developing chambers are arranged around an axis of rotation. The developing unit is rotated about the axis to bring one of the chambers to a developing position where an image carrier is located. In each of the chambers, part of a developer removed by a doctor blade is received by a guide and then released from the guide into the chamber. This part of the developer is agitated in the vertical direction together with the developer existing in the chamber by the rotation of the device. As a result, the developer is agitated and charged in a desirable manner.

6 Claims, 8 Drawing Sheets

ROTARY DEVELOPING DEVICE FOR AN IMAGE FORMING APPARATUS

This application is a continuation of application Ser. No. 08/459,423, filed on Jun. 2, 1995, now abandoned.

BACKGROUND OF THE INVENTION

1. Field of the Invention

The present invention relates to a developing device for a copier, facsimile apparatus, printer or similar image forming apparatus and, more particularly, to an improvement in the agitation and charging of a developer in a rotary developing device having a developing unit in which a plurality of developing chambers are arranged around an axis of rotation, and rotating the unit about the axis to locate any one of the chambers at a developing position where an image carrier is located.

2. Discussion of the Background

A rotary developing device, or revolver as generally referred to, is disclosed in Japanese Patent Laid-Open Publication Nos. 62-251772 and 63-78170 by way of example.

The revolver is made up of a rotary developing unit, a rotary developer storing unit, and conveying means. The developing unit has a plurality of developing sections or chambers arranged around an axis of rotation. A plurality of storing chambers are defined in the storing unit in one-to-one correspondence with the developing chambers. The conveying means conveys a developer from the respective storing chamber to the associated developing chamber. The developing unit, storing unit and conveying means are rotated about the axis integrally to bring one of the developing chambers to a developing position where an image carrier is located. This developing device will be referred to as Prior Art 1.

Japanese Patent Publication No. 64-8330 and Japanese Patent Laid-Open Publication No. 61-243467, for example, teach a revolver in which the developing unit and the developer storing unit are configured independently of each other, and only the developing unit is rotatable. In this revolver, the conveying means for conveying the developer from the storing unit has its end implemented as a structural body unrotatably disposed in a bore formed at the center of the developing unit. The developer is dropped from an outlet formed in the bottom of the structural body into a developing chamber by gravity. This developing device will be referred to as Prior Art 2.

Assume that any one of the above revolvers is loaded with developers of different colors in order to form a full-color image. Then, the developing chambers of the developing unit must be sequentially replaced during the course of image formation. This brings about a problem that the developer in each developing chamber cannot be sufficiently agitated, and a problem that the charge deposited on the developer fed from the storing chamber to the developing chamber is short. The short agitation results in the irregular density distribution of an image while the short charge contaminates the background of an image and causes the developer to fly about.

To eliminate these problems, previously mentioned Publication No. 64-8330 proposes to subdivide each developing chamber into two compartments by a partition. An agitating screw is disposed in each of the compartments. An opening is formed in opposite ends of the partition to provide communication between the compartments. The screws in the compartments are driven to circulate a developer through the compartments via the openings of the partition. The developer dropped from the outlet of the structural body is received in one of the compartments and mixed and agitated with the existing developer to a certain degree. The resulting mixture is transferred to the other compartment where a developing roller is positioned. The above document also proposes to move the developer, fed from the outlet into the chamber located just below the outlet, to a developing position different from such a position and where an image carrier is located. This kind of scheme allows the replenished developer to be mixed with the existing developer and charged to a certain degree before it arrives at the developing position. Hence, even immediately after the replenishment, it is possible to effect development at the developing position without irregularity.

Laid-Open Publication No. 61-243467 also mentioned previously proposes to mount on the apparatus body an exclusive developing roller driveline which faces the chamber brought to the above-stated position just below the outlet. The exclusive driveline drives the developing roller of the chamber in order to agitate the replenished developer together with the existing developer within the chamber.

In the structure taught in Publication No. 64-8330, when the relation between the two compartments is inverted in the up-and-down direction due to the rotation of the developing unit, the developer is agitated in the vertical direction during the movement from the upper compartment to the lower compartment. However, because the vertical agitation occurs via the openings at opposite ends of the partition with respect to the widthwise direction, irregular development is apt to occur in the widthwise direction unless the developer is sufficiently agitated in the above direction, i.e., horizontal direction, afterwards. Assume that the developer dropped from the outlet of the structural body is directly replenished into one compartment and mixed with the existing developer by the screw, as also taught in the above document. Then, it is likely that the charge deposited on the replenished developer is short because of the agitation efficiency lower than in the case the developer is agitated in a tube or similar limited space. Further, assume that the developer replenished into the chamber just below the outlet is moved to the developing position remote from such a position, as further taught in the above document. This configuration, however, needs a special structure as discussed in relation to Prior Art 2 and does not give any consideration to the application to Prior Art 1 having a different basic structure.

In the scheme for agitating the replenished developer in the chamber located just below the outlet, as taught in previously mentioned Laid-Open Publication No. 61-243467, the exclusive driveline is mounted on the apparatus body. This increases the number of positions where the developing unit and the drive system on the apparatus body engage and disengage during the rotation of the revolver, aggravating the vibration of the revolver. Another problem with this scheme is that sufficient agitation is not attainable, depending on the rotation speed of the developing roller driven by the exclusive driveline.

SUMMARY OF THE INVENTION

It is, therefore, an object of the present invention to provide a rotary developing device capable of agitating a developer in a desirable manner by the rotation of a developing unit.

It is another object of the present invention to provide a rotary developing device of the type rotating, integrally about a single axis, a developing unit, a developer storing unit and conveying means for conveying a developer from the developer storing chambers of the storing unit to the developing chambers of the developing unit, which device can replenish a developer into the developing chamber not located at a developing position from the associated storing chamber.

It is still another object of the present invention to provide a rotary developing device capable of agitating a developer in a developing chamber not located at a developing position without aggravating vibration.

It is a further object of the present invention to provide a rotary developing device capable of agitating a developer sufficiently in a developing chamber not located at a developing position, and thereby effecting desirable development when the chamber is brought to the developing position.

In accordance with the present invention, in a rotary developing device in which a developing unit having a plurality of developing chambers arranged around the axis of rotation is rotatable about the axis to move any one of the developing chambers to a developing position where an image carrier is located, the developing chambers each have a developer carrier, a regulating member for regulating the amount of a developer deposited on and being conveyed by the developer carrier toward the developing position, a guide member having an opening identical in width as the regulating member, and for receiving the developer removed from the developer carrier by the regulating member, and a conveying member for conveying the developer received by the guide member along the guide member.

Also, in accordance with the present invention, a rotary developing device has a developing unit having a plurality of developing chambers arranged around the axis of rotation, and rotatable about the axis to move any one of the developing chambers to a developing position where an image carrier is located. A developer storing unit has a plurality of developer receptacles respectively corresponding to the developing chambers. A conveying member conveys a developer from each of the developer receptacles to one of the developing chambers. A rotatable hollow member is disposed in each of the developing chambers and formed with a plurality of agitating blades, each extending over the width of an effective developing range, at predetermined circumferential intervals. The conveying member extends in the hollow member over the above width. The hollow member is formed with developer outlets in the circumferential wall thereof.

Further, in accordance with the present invention, a rotary developing device has a developing unit having a plurality of developing chambers arranged around the axis of rotation, and rotatable about the axis to move any one of the developing chambers to a developing position where an image carrier is located. A developer storing unit has a plurality of developer receptacles respectively corresponding to the plurality of developing chambers. A conveying member conveys a developer from each of the developer receptacles to one of the developing chambers. The conveying member is arranged such that at at least one position other than the developing position, part of the conveying member of one developing chamber located at the above position is located in the developer receptacle at a position where the developer is present. The developer is replenished into the developing chamber located at the above position.

Furthermore, in accordance with the present invention, a rotary developing device in which a developing unit having a plurality of developing chambers arranged around the axis of rotation and each having a developer agitating member thereinside is rotatable about the axis to locate any one of the developing chambers at a developing position where an image carrier is located has a drive inputting device for inputting a driving force to one of the developing chambers located at the developing position. A drive transmitting device transmits, at the developing unit side, the driving force to at least one of the developing chambers not located at the developing position.

Moreover, in accordance with the present invention, in a rotary developing device in which a developing unit having a plurality of developing chambers arranged around the axis of rotation and each having a developer agitating member thereinside is rotatable about the axis to locate any one of the developing chambers at a developing position where an image carrier is located, the developer agitating device of one of the developing chambers located at the developing position and the developer agitating member of at least one of the other developing chambers are drivable. The developer agitating member of the developing chamber not located at the developing position has a higher agitation speed than the developer agitating member of the developing chamber located at the developing position.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
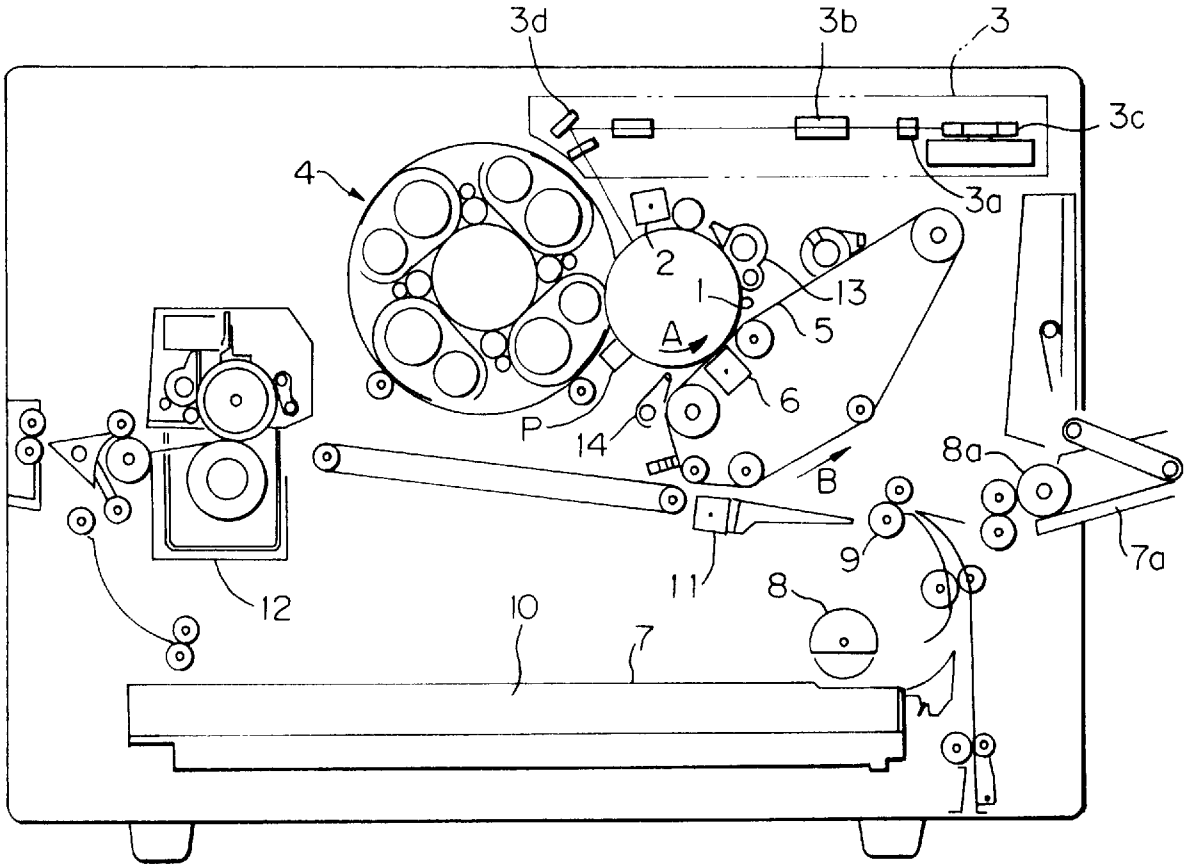
FIG. 1 is a sectional view showing an image forming apparatus to which a rotary developing device embodying the present invention is applied.

Referring to FIG. 1 of the drawings, an image forming apparatus to which a rotary developing device embodying the present invention is applied is shown and implemented as an electrophotographic color printer. As shown, the printer has a photoconductive drum, or image carrier, 1 which is rotated in a direction indicated by an arrow in the figure. A main charger 2 uniformly charges the surface of the drum 1. Laser optics 3 scans the charged surfaces of the drum 1 in accordance with image data and thereby electrostatically forms a latent image thereon. The image data consist of yellow data, magenta data, cyan data and black data generated by separating a desired full-color image.

Latent images sequentially formed on the drum 1 are each developed by one of a yellow toner, magenta toner, cyan toner and black toner stored in a rotary developing device or revolver 4 which will be described. As a result, the latent images are transformed to toner images of respective colors.

An intermediate transfer belt 5 is rotated in synchronism with the drum 1 in a direction B. The toner images formed on the drum 1 are sequentially transferred to the belt 5 by a primary transfer charger 6 one above the other, thereby forming a composite color image. A sheet of paper 10 is fed from a duplex copy/automatic paper feed casette 7 or a manual paper feed tray 7*a* to an image transfer position by a pick-up roller 8 or 8*a* and a registration roller pair 9. A secondary transfer charger 11, located at the image transfer position, transfers the composite color image from the belt 5 to the paper 10. A fixing unit 12 fixes the color image on the paper 10. The paper 10 with the color image is driven out of the printer as a full-color printing. A drum cleaner 13 removes the toner remaining on the drum 1 after the image transfer. Likewise, a belt cleaner 14 removes the toner remaining on the belt 5 after the image transfer.

Figure 2:
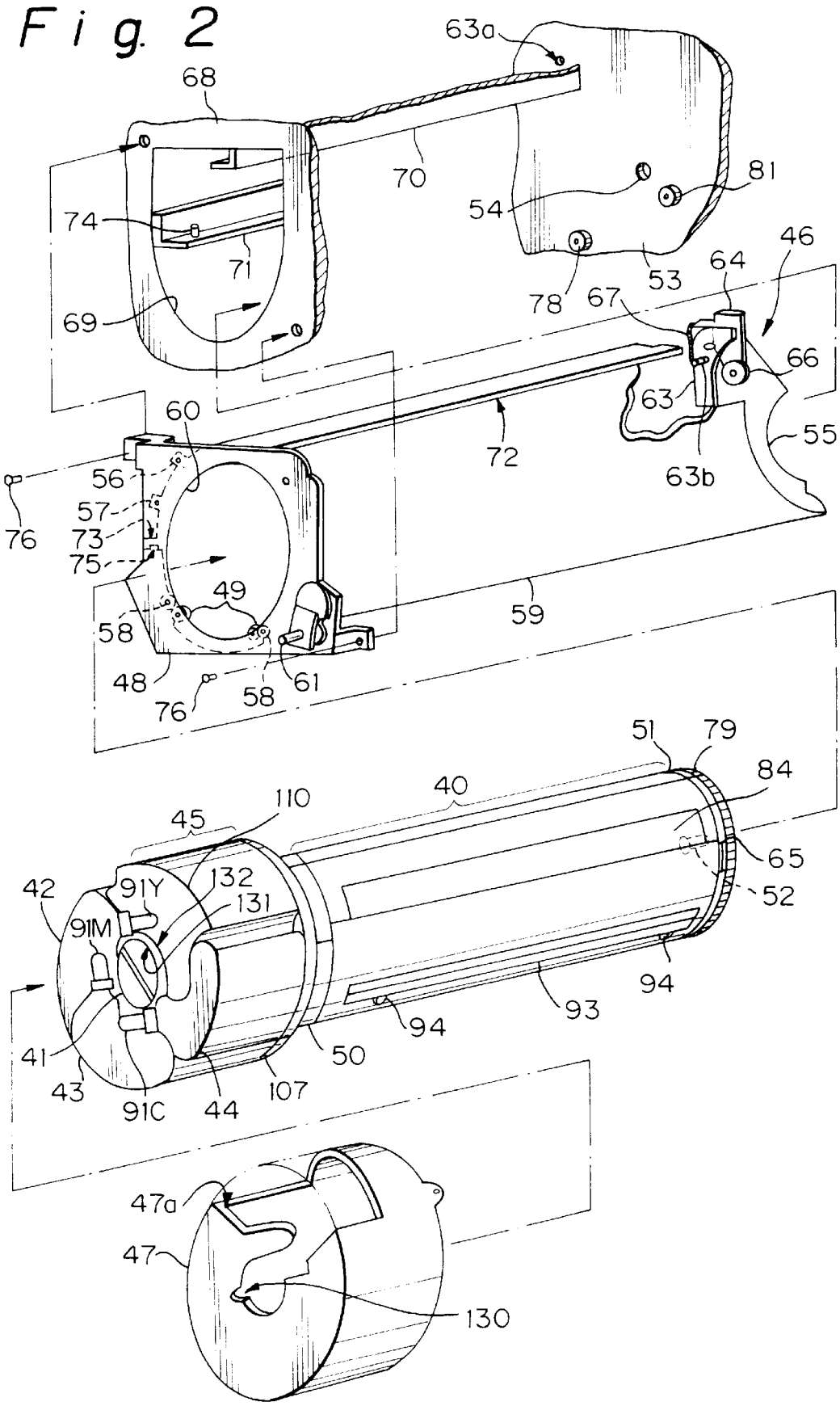
FIG. 2 is an exploded external perspective view of the embodiment.

As shown in FIG. 2, the revolver 4 embodying the present invention has a substantially cylindrical developing unit 40 and a toner storing unit 45. The developing unit 40 is rotatable about its own axis and has four developing sections or chambers therein which are assigned to, for example, black, cyan, yellow, and magenta, respectively. The toner storing unit 45 is coaxial with and located at the front of the developing unit 40. Four toner containers 41, 42, 43 and 44 are removably mounted to the storing unit 45 and held in one-to-one correspondence with the four developing chambers of the developing unit 40. The toner containers 41–44 store black toner, yellow toner, magenta toner, and cyan toner, respectively. The storing unit 45 is rotatable integrally with the developing unit 40. A casing 46 supports the developing unit and storing unit 45, i.e., the revolver and is slidable relative to the printer body substantially in parallel to the axis of the revolver. A cover 47, which is not rotatable, covers the storing unit 45.

Two support rollers 49, for example, are mounted on the front support wall 48 of the casing 46. The developing unit 40 has a front wall 50 and a rear wall 51 each having a disk-like configuration. The front wall 50 is supported by the support rollers 49. A tapered center shaft 52 extends out from the center of the rear wall 51 and is rotatably received in a hole 54 formed in a rear panel 53 forming part of the printer body. In this condition, the revolver is rotatable in the printer body and positioned such that the axis thereof is parallel to the axis of the drum 1 substantially in the same plane, as shown in FIG. 1.

A mechanism for rotatably supporting the revolver will be described with reference to FIG. 2. As shown, the casing 46 has, in addition to the front support wall 48, a rear support wall 55 and a side cover 59. The side cover 59 is affixed to the support walls 48 and 55 at opposite ends thereof and reinforced by tie rods 56, 57 and 58. An opening 60 is formed through the front support wall 48 for receiving the revolver. A motor 61 and a gear train 62 (see FIG. 3) are also mounted on the support wall 48. The motor 61 drives via the gear train 62 toner supply rollers which are disposed in the toner storing unit 45. An intermediate plate 63 is disposed in the casing 46 and supported by the tie rods 56 and 57 in the vicinity of the rear support wall 55. A positioning pin 63*b* is studded on the plate 63 and received in a positioning hole 63*a* formed in the rear panel 53. A bracket 64 is rotatably mounted at one end thereof on the part of the pin 63*b* intervening between the plate 63 and the rear support wall 55. A positioning roller 66 is mounted on the other end of the bracket 64. The roller 66 falls in any one of a plurality of (four in the embodiment) recesses 65 formed in the outer periphery of the rear end wall of the developing unit 40. A spring 67 constantly biases the bracket 64 in a direction indicated by an arrow.

A front panel 68 included in the printer body is formed with an opening 69 for receiving the casing 46 carrying the revolver therewith. An upper guide 70 and a lower guide 71 extend between the front panel 53 and the rear panel 68 of the printer body. The casing 46 is slidably supported by the guides 70 and 71. Specifically, the side cover 59 of the casing 46 has portions 72 and 73 to be guided by the guides 70 and 71 at the top and the side, respectively. A channel 73 is formed in the bottom of the portion 73 and receives an upright guide pin 74 studded on the guide 71. When the casing 46 is moved into and out of the printer body, the channel 75 causes it to move away from the drum 1. Also, when the casing 46 is fully set on the printer body, the channel 75 guides the revolver to a predetermined position relatively close to the drum 1. For this purpose, the channel 75 is bent such that a predetermined front portion thereof is closer to the drum 1 than a rear portion.

The positioning pin 63*b,* studded on the intermediate plate 63, has a tapered tip. The tapered tip begins to enter the hole 63*a* of the rear panel 53 immediately before the casing 46 is fully received in the printer body, and accurately positions the rear support wall 55 and bracket 63 of the casing 46 when the casing 46 is fully received. When the casing is not inserted in the printer body, the rear end of the revolver is supported by the rear support wall 55 of the casing 46. However, immediately before the casing 46 is fully received in the printer body, the tapered center shaft 52 begins to enter the hole 54 of the printer rear panel 53, sequentially raising the revolver. When the casing 46 is fully inserted into the printer body, the revolver is fully raised above the support wall 55. The front support wall 48 is affixed to the printer front panel 68 by, for example, screws 76 after the casing 46 has been inserted in the printer body. In this condition, the front end of the revolver is supported by the rollers 49 of the front support wall 48 which has been accurately positioned on the printer body. At the same time, the rear end of the revolver is rotatably positioned relative to the printer rear panel 53.

A revolver drive gear 78 is mounted on the printer rear panel 53 and driven by a stepping motor or similar revolver drive motor, not shown. The drive gear 78 is held in mesh with a revolver input gear 79 having substantially the same diameter as the gear 78 (see also FIG. 5A). The gear 79 is fastened to the rear of the rear end wall of the developing unit 40. Also mounted on the printer rear panel 53 is a development drive gear 81 driven by a motor, not shown, to drive developing rollers 84 and other rotary bodies built in the developing unit 40 (see also FIG. 5A).

The developing unit 40 will be described with reference to FIG. 3. As shown, the developing unit 40 has, in addition to disk-like front and rear end walls 50 and 51, partition walls intervening between the front and rear walls. The partition walls consist of a hollow cylindrical portion 82 for receiving a cylindrical black toner container or bottle, and four casing portions 83, 83C, 83M and 83Y. The casing portions 83–83Y extend radially from the cylindrical portion 82 and partition the space around it into four developing chambers having substantially an identical shape. The chambers each store a mixture of carrier and toner of particular color, i.e., a two-component type developer. In the condition shown in FIG. 5, the chamber storing the black toner and carrier is shown as facing the drum 1 at the developing position. The chambers storing the yellow toner and carrier, magenta toner and carrier, and cyan toner and carrier, respectively, are sequentially arranged in this order in the counterclockwise direction, as viewed in the figure.

The following description will concentrate on the black developing chamber located at the developing position. The constituents of the other developing chambers are distinguished from the constituents of the black developing chamber and from each other simply by suffixes Y, M and C.

In the black developing chamber, the casing part 83 is formed with an opening facing the drum 1. A developing roller 84 is positioned in the chamber and partly exposed to the outside through the opening. Also disposed in the chamber are a doctor blade 85, an upper screw 86, and a guide 87 for the screw 86. The doctor blade 85 regulates the amount of toner to be conveyed by the roller 84 to the developing position. The upper screw 86 conveys part of the developer removed by the doctor blade 85 from the rear to the front along the axis thereof. The guide 87 is implemented as a top-open trough identical in width with the doctor blade 85 and contributes to the agitation of the developer in the chamber in the vertical direction, as will be described later specifically.

Figure 4A:
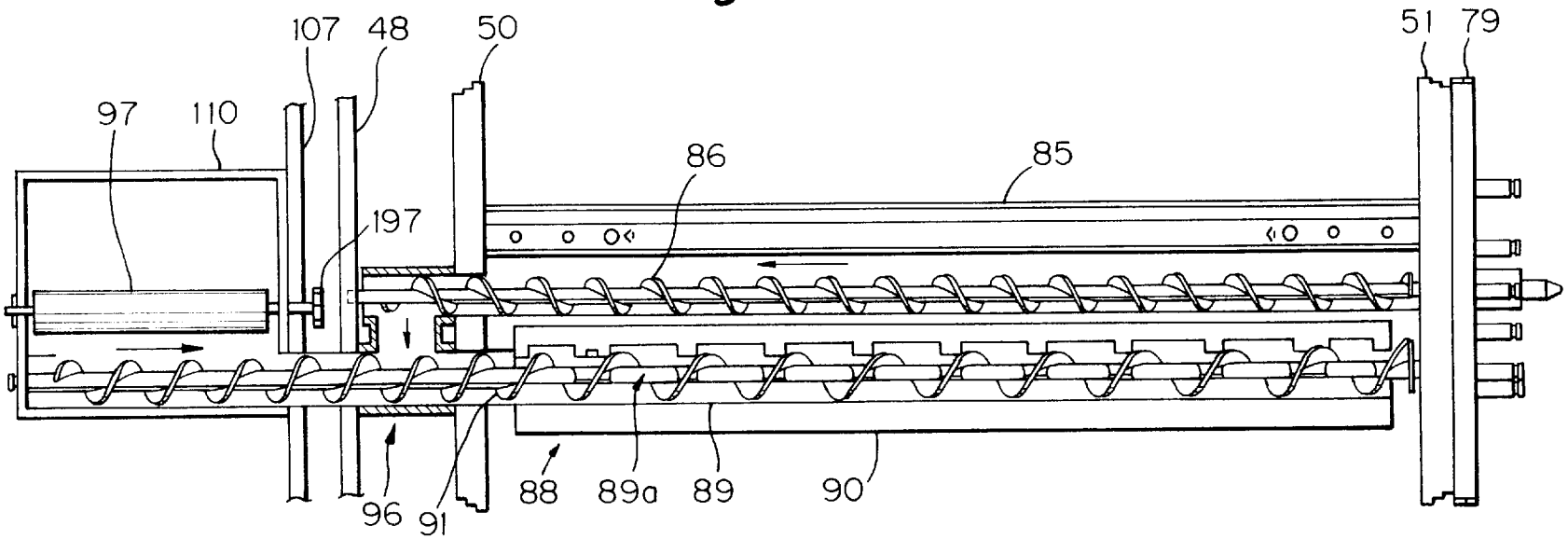
FIG. 4A is a vertical sectional view in a plane containing the axis of upper and lower screws disposed in a black developing chamber.
Figure 4C:
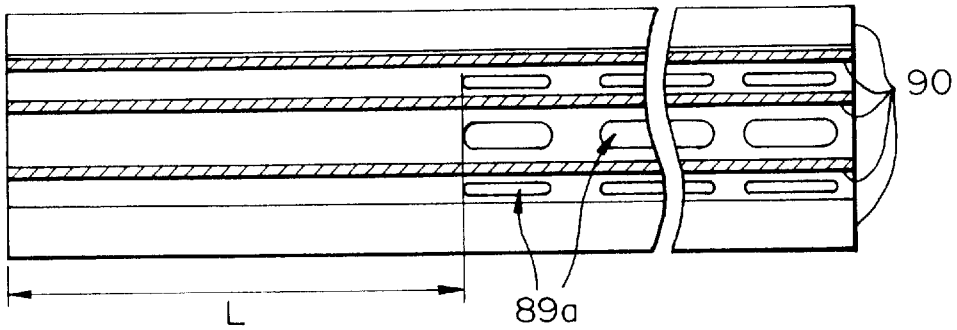
FIGS. 4B and 4C show a modified form of a paddle for agitation.
Figure 4B:
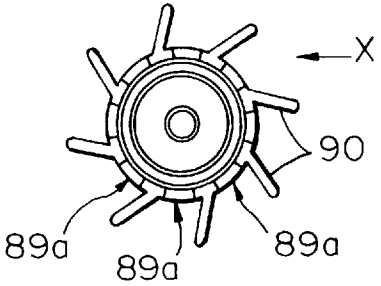

A paddle 88 is also disposed in the developing chamber. For example, as shown in FIGS. 4A and 4B, the paddle 88 has a hollow cylindrical portion 89 formed with a plurality of developer outlets 89*a* extending in the axial direction of the roller 84, and a plurality of blades 90 extending radially from the portion 89. A lower screw 91 is disposed in the portion 89 and conveys the developer along the axis thereof in the opposite direction to the screw 86. The casing portion is formed with an outlet 92 below the lower screw 91. The outlet 92 extends in the axial direction of the revolver and is selectively used to discharge a deteriorated developer or to replenish a fresh developer (with toner). A cap 93 is fitted on the casing portion by, for example, a screw 94 in order to close the outlet 92.

As shown in FIG. 4A, the front ends of the upper and lower screws 86 and 91 extend out from the front end wall 50 of the developing unit. A drop section 96 is formed around the extensions of the screws 86 and 91. In the drop section 96, the developer conveyed by the screw 86 is dropped onto the screw 91 by gravity. In this configuration, the developer deposited on the roller 84 is partly removed by the doctor blade 85 and then conveyed to the front by the guide 87 and screw 86. At the drop section 96, this part of the developer is dropped onto the screw 91. The screw 91 conveys the developer into the effective width of the roller 84. As a result, the developer is discharged into the chamber via the outlets 89*a* of the paddle 88. In this manner, the developer is agitated in the chamber in the horizontal direction. The developer discharged to the lower portion of the chamber via the outlets 89*a* is agitated by the blades 90 of the paddle 88 in the vertical direction.

The front end of the screw 91 is further extended beyond the drop section 96 into one of receptacles 91Y, 91M, 91C and 110 respectively communicated to the developing chambers, more specifically to below toner supply rollers 97 respectively disposed in the receptacles 91Y–110. In this configuration, fresh toner from the toner storing unit 45 is introduced into the developer being agitated in the horizontal direction in the drop section 96. While the toner and developer are conveyed in the hollow cylindrical portion 89 of the paddle 88, the former is mixed with the latter and thereby frictionally charged. As shown in FIG. 4C, the developer outlets 89*a* may be distributed only over a range of from the intermediate point of the portion 89 to the downstream end in the direction in which the screw 91 conveys the developer. The other range, labeled L, closer to the toner storing unit 45 is not formed with any outlet 89*a*. This guarantees an agitating time in the portion 89. When the portion 89 is rotated integrally with the lower screw 91 in order to simplify the driveline, the agitating time is particularly effective in avoiding short agitation.

Figure 3:
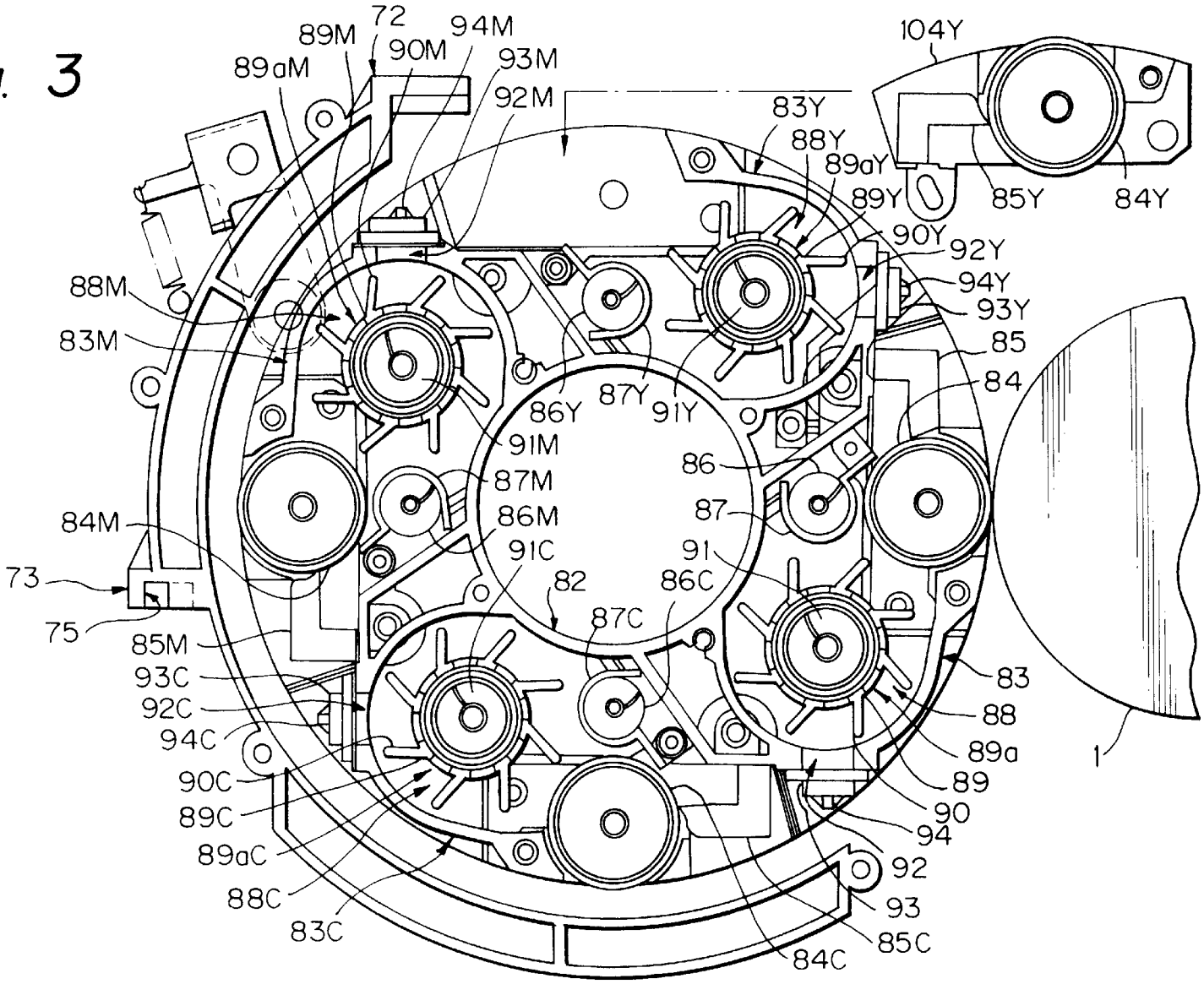
FIG. 3 is sectional view of a developing unit included in the embodiment.

As shown in FIG. 3, the yellow developing unit, for example, has a developing roller 84Y and a doctor blade 85Y supported by front and rear small wall pieces 104 which are separable from the other front and rear wall portions. When the chamber should be cleaned or when the parts should be replaced, the small wall pieces 104, carrying the roller 84Y and blade 85Y therewith, can be bodily removed to facilitate the access to the chamber.

Figure 5A:
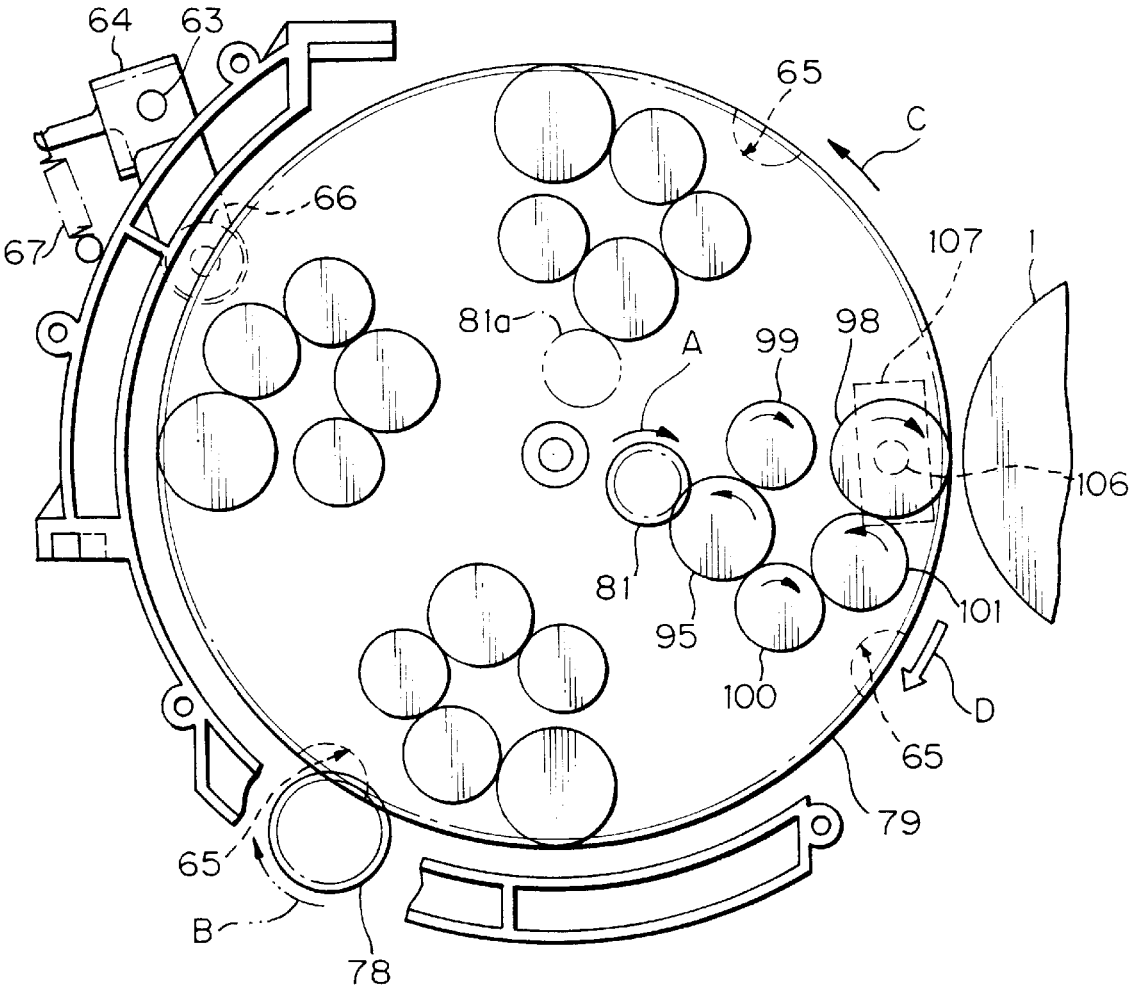
FIG. 5A is a perspective front view showing a driveline included in the developing unit.

FIG. 5A shows a mechanism for rotating the developing rollers and other rotary bodies of the developing unit 40. As shown, various gears are mounted on the wall 51 at the rear of the revolver input gear 79. The shaft of the developing roller 84 extends throughout the wall 51 to the rear of the input gear 79. A gear 98 is mounted on the protruding end of the shaft of the roller 84. Likewise, the shafts of the screws 86 and 91 extend throughout the wall 51 to the rear of the input gear 79. Gears 99 and 100 are mounted on the protruding ends of the screws 86 and 91, respectively. An idle gear 101 is mounted on the rear of the wall 51 and held in mesh with the gears 98 and 100. An input gear 95 is also mounted on the rear of the wall 51 and engageable with the output gear 81. The revolver, carrying such gears on the wall 51 thereof, is received in the casing 46 and then inserted into the printer body, as stated earlier. As a result, the input gear 95 of the revolver is brought into mesh with the output gear 81 of the printer body, as shown in FIG. 5A. At the same time, the input gear 79 of the revolver meshes with the output gear 78 of the printer body.

FIG. 5A shows a condition wherein the gears stated above are in full mesh with each other. In this condition, the output gear 81 is rotated in a direction A with the result that the gears 99 and 100 are rotated via the input gear 95. The gears 99 and 100 cause the screws 86 and 91 to rotate. Further, the gear 98 is rotated via the input gear 95, gear 100 and idle gear 101 and, in turn, rotates the developing roller 84.

To replace the developing chamber to be used, the output gear 78 is rotated in a direction B, FIG. 5A to thereby rotate the revolver in a direction C. Then, the roller 66 falls in one of the recesses 65 which is formed in the outer periphery of the rear end wall 51 of the revolver. After the positioning of the revolver, when the gear 81 is rotated in the direction A, a moment of rotation acts on the revolver in a direction indicated by an arrow D. To position the revolver by overcoming the moment, each recess 65 may preferably be made up of two portions 65*a* and 65*b;* the portion 65*b* has a smaller inclination than the portion 65*a*. The roller 66 easily leaves the recess 65 via the portion 65*a* during usual revolution. The other portion 65*b* is used to lock the revolver.

Figure 5B:
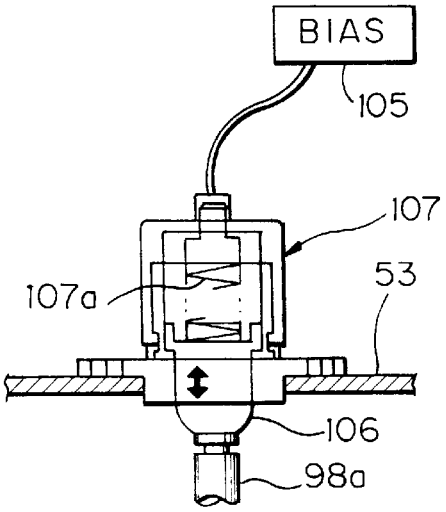
FIG. 5B shows a bias applying mechanism.

As shown in FIGS. 5A and 5B, a bracket 107 is mounted on the printer rear panel 53 at a position facing the developing roller shaft 98*a* when the shaft 98*a* is brought to the developing position. A rod-like terminal 106 is supported by the bracket 107 in such a manner as to be retractable in the sliding direction of the casing 46. A spring 107*a* constantly biases the terminal 106 forward.

Figure 7:
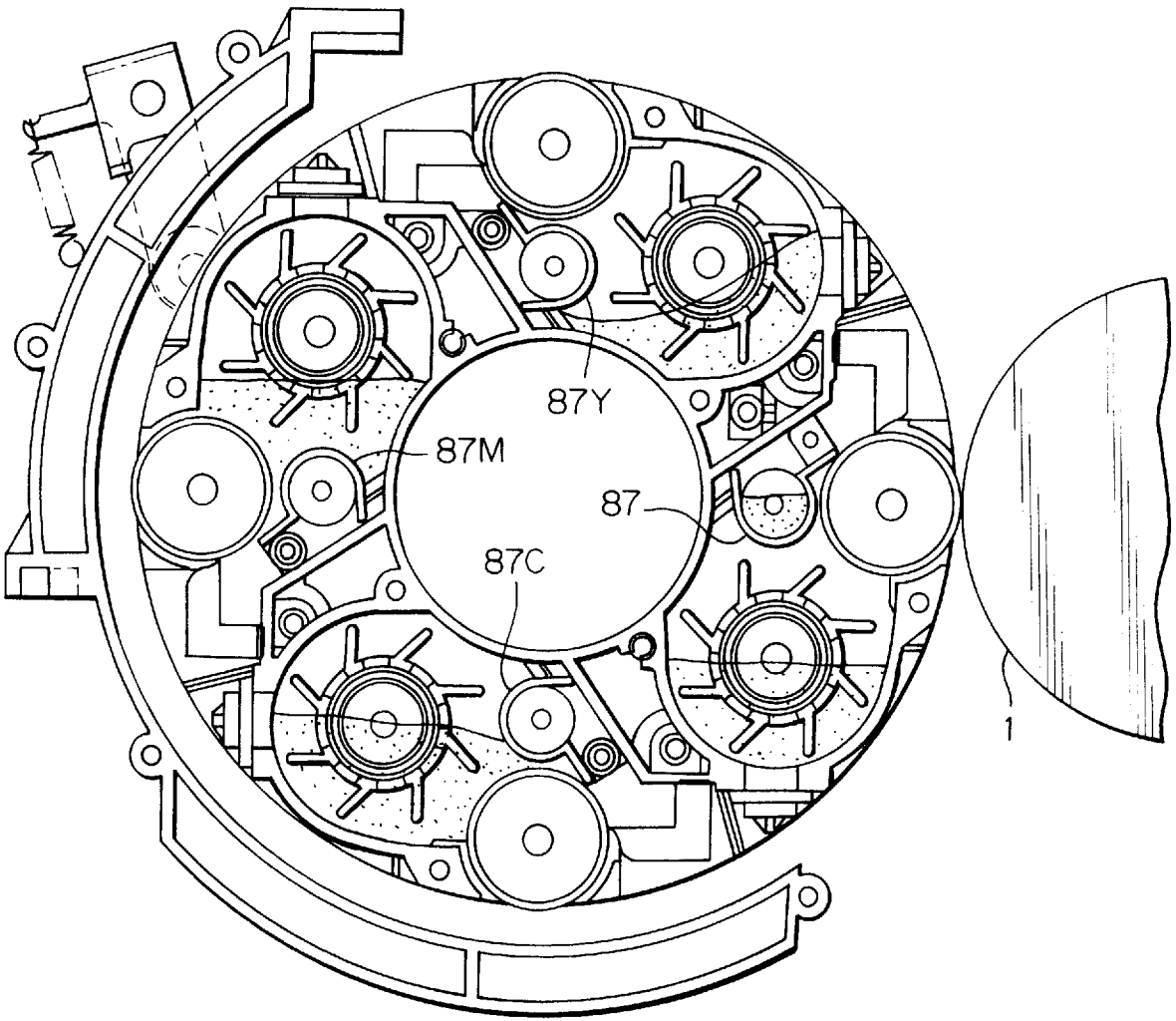
FIG. 7 demonstrates how a developer is agitated in the developing unit in the vertical direction.

During the rotation of the revolver described above, the developer is agitated in the vertical direction by the guide 87 as well as by the other members. Specifically, as shown in FIG. 7 by way of example, when the revolver is rotated counterclockwise, the developer accumulated on the guide 87 due to development at the developing position is discharged from the guide 87, as represented by the chamber rotated 90 degrees away from the developing position in the counterclockwise direction. Then, this part of the developer is mixed and agitated with the developer existing in the chamber in the vertical direction, as represented by the chambers 180 degrees and 270 degrees remote from the developing chamber. When the revolver is fully rotated 360 degrees to the developing position, the developer removed by the doctor blade during development is again received by the guide and then conveyed by the upper screw.

Figure 6:
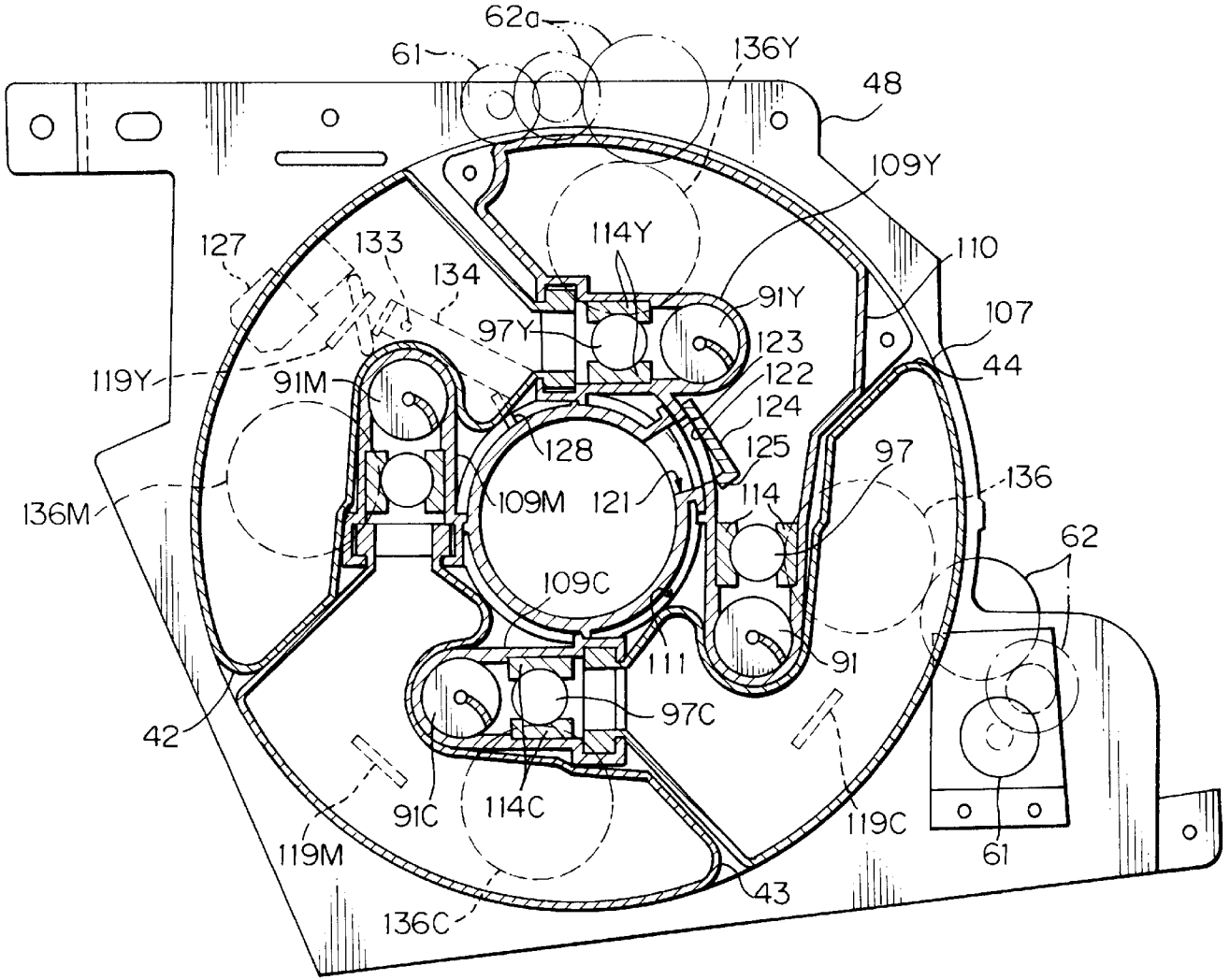
FIG. 6 is a section showing the internal arrangement of a toner storing unit also included in the embodiment.

Reference will now be made to FIG. 6 for describing the toner storing unit 45. As shown, the storing unit 45 has a disk-like base plate 108 (see also FIG. 2). Four receptacles, or cases, 109Y, 109M, 109C and 110 are affixed to the front end of the base plate 108, and each corresponds to one of the chambers of the developing unit 40. Toner supply rollers 97Y, 97M, 97C and 97 are disposed in the receptacles 109Y, 109M, 109C and 110, respectively. The rollers 97Y–97 are journalled to the base plate 108 and the front walls of the associated receptacles 109Y–110 such that they will each be positioned substantially just above the extension of the screw 91 when the corresponding chamber is brought to the developing position.

The base plate 108 is formed with a circular through hole 111 at the center thereof. The hole 111 allows the cylindrical black toner container to be passed therethrough. The receptacles 109Y–110 are so positioned as not to interfere with the hole 111. Also formed in the base plate 108 are through holes for the lower screws 91 each extending into one of the receptacles 109Y–110 through the base plate 108.

The shafts of the rollers 97Y–97 are journalled to the base plate 108. A gear 197 is mounted on the end of a shaft extending throughout the base plate 108 toward the developing unit 40 (see FIG. 4A). As shown in FIG. 6, an input gear 136 is held in mesh with the gear 197. The gears 197 and 136 are assigned to each of the rollers 97Y–97. As shown in FIG. 6, when one developing chamber of the developing unit 40 is brought to the developing position, the input gear 136 corresponding to the chamber is brought into mesh with the gear 62 which is driven by the motor 61. Toner replenishment control is effected by controlling the motor 61.

The receptacles 109Y, 109M and 109C assigned to the color developing chambers have an identical configuration. As shown in FIG. 6, the cyan toner receptacle 109C, for example, has a wall surrounding the portion of the lower screw 91 present in the receptacle 109C. The wall is formed with a toner inlet at such a position that the inlet overlies the toner supply roller 97C when the associated chamber is located at the developing position. The inlet is surrounded by a mount portion 113. The cyan toner container 44 is mounted to the mount portion 113 with the outlet thereof facing downward, by being slid in the axial direction of the revolver. Seal members 114C are fitted on part of the inner periphery of the receptacle 109C which face the roller 97C. The seal members 114C and roller 97C divide the interior of the mouth portion 113 into two portions respectively adjoining the toner container 44 and the chamber. In addition, the seal members 114C and the wall, surrounding the roller 97C and screw 91C, define the previously mentioned communication chamber which is communicated to the associated developing chamber via the hole of the base plate and drop section. The rollers 97Y–97 each includes a roller portion formed with a plurality of axial grooves.

The containers 42–44 are each configured to be engageable with the wall of the receptacle located upstream, in the direction of rotation of the revolver, of the receptacle to which it corresponds. Lugs 119Y, 119M and 119C are respectively formed on the outer surface of the rear wall 51, and each is sensed by a respective set sensor.

The receptacle 110 assigned to the black developing chamber has a far greater space than the receptacles 109Y–10C assigned to the color developing chambers. Specifically, as shown in FIG. 6, the receptacle 110 has a wall substantially identical with the contour of the color toner receptacle 109Y, 109M or 109C and color toner container 42, 43 or 44 mounted thereto. Seal members 114 are fitted on the inner periphery of the portion of the receptacle 110 corresponding to the receptacle. Also, the seal members 114 define a communication chamber communicated to the associated developing chamber in cooperation with the wall surrounding the screw 91. The wall portion similar to the color toner container is formed with a toner inlet 122 in part thereof which faces the center line of the revolver. The toner inlet 122 is identical in shape with the toner outlet 121 of the container 41. Black toner is received from the container 41 via the inlet 122. A shutter 124 is rotatably supported at one end by a shaft 123 parallel to the axis of the revolver. A seal member 125 is fitted on the edge of the shutter 124.

The black toner container 41 is cylindrical and has the outlet 121 formed in the circumferential wall of one end portion thereof. A spiral ridge is formed in the inner periphery of the container 41 from the end remote from the outlet 121 toward the outlet 121. When the container 41 is mounted to the revolver, the ridge rotates integrally with the revolver so as to feed the toner from the rear end toward the outlet 121. A lug 128 to be sensed is provided on the outer periphery of the container 41 at the rear of the outlet 121.

Specifically, the cover 47 is formed with a notch 130 and a notch 47*a* for the insertion of the container 41. The container 41 is positioned such that the outlet 121 faces upward. After the seal member closing the outlet 121 has been removed, the container 41 is inserted into the revolver through the notch 47*a* with the lug 128 thereof aligned with the notch 130. The container 41 is inserted to the deepest position where the rear end is received in the hollow cylindrical portion 82 of the developing unit 40, and where the front end is substantially flush with the the front walls of the receptacles of the storing unit 40. Then, the container 41 is rotated clockwise, as viewed in the figures, about its own axis with a grip portion thereof held by hand, until the outlet 121 aligns with the inlet 122. This rotation will be referred to as a set rotation hereinafter. During the set rotation, the lug 128 is sensed by a link 134 mounted on the revolver, specifically on the rear of the casing front wall 48, and a set sensor 127. The link 134 is rotatable about a fulcrum 123.

As stated above, the developer accumulated in the guide 87 is discharged and agitated in the vertical direction due to the rotation of the revolver. During the course of development, the toner from the container is charged by being agitated in the hollow tubular portion of the paddle and then fed to the developing chamber. The embodiment, therefore, ensures desirable development.

With reference to FIG. 6, a modification of the embodiment in which the toner is replenished into the developing chamber at a position different from the developing position will now be described. In the above embodiment, the motor 61 is located at a position for driving the gear 197 of the replenishing roller 91 associated with the chamber which is brought to the developing position, while the toner from the container is fed into the chamber after being charged beforehand. However, when the toner is replenished during development, there is some fear that the toner contaminates, for example, the background of an image due to short charging. It is, therefore, preferable to effect the replenishment at a position other than the developing position. When the storing unit 45 rotates integrally with the developing unit 40, as in the embodiment, it is necessary to select the replenishing position in consideration of the movement of the toner in the containers and receptacles. Specifically, the prerequisite is that the toner conveying means consisting of the replenishing roller and lower screw, particularly the replenishing roller, be positioned in the range of the container and receptacle where the toner is present. Stated another way, each replenishing roller should be so arranged as to exist in the above range when the associated chamber is present at at least one angular position other than the developing position.

In light of the above, as indicated by dash-and-dots lines in FIG. 6, the motor 61 and transmission gears 62*a* are so positioned as to drive the replenishing roller (97Y in the condition shown in the figure) associated with the chamber which has been rotated 90 degrees away from the developing position in the counterclockwise direction.

Figure 8:
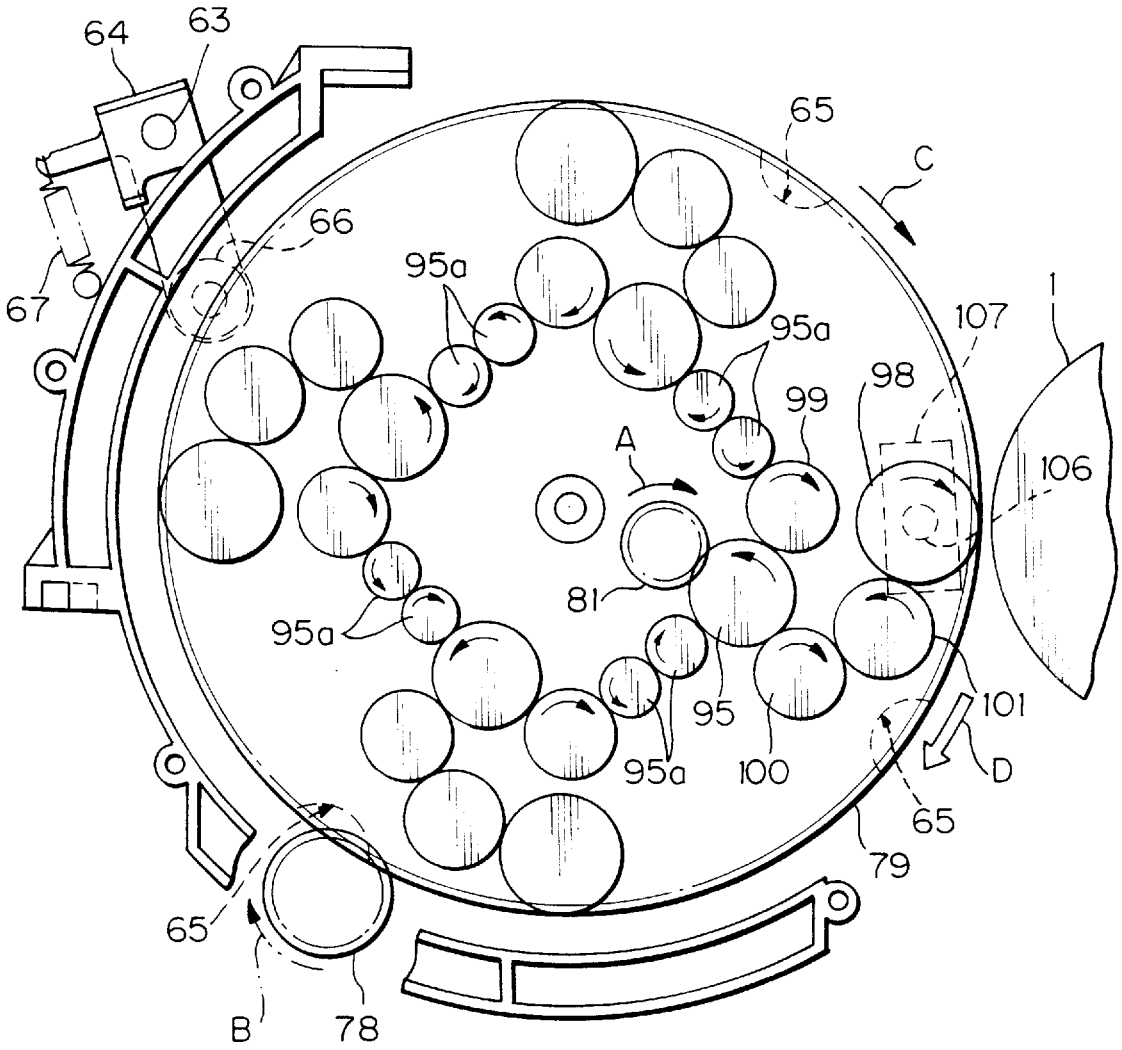
FIG. 8 is a perspective front view of a driveline included in a modification of the embodiment.

To replenish the toner, not only the replenishing roller but also the lower screw, preferably the upper and lower screws, must be rotated. The screws of the chamber located at the replenishing position may be driven by any one of the following schemes. For example, as indicated by a dash-and-dots line in FIG. 5A, a drive gear 81*a* may be added in order to directly transfer the torque to the chamber brought to the replenishing position. Alternatively, as shown in FIG. 8, intermediate gears 95*a* may be mounted on the rear wall 51 of the developing unit 40 and transfer the torque input to the chamber located at the developing position to the other chambers. Particularly, the scheme shown in FIG. 8 is desirable from the vibration standpoint because the drive gear 81 and input gear 95 should only be brought into and out of mesh at a single position, i.e., at the chamber located at the developing position.

The additional arrangement shown in FIG. 5A or 8 is useful alone even if it is isolated from the toner replenishment, as follows. When the developer is agitated only at the developing position, the agitation is apt to be short because the revolver must be rotated for switching the color. By driving the screws even at the positions other than the developing position, it is possible to obviate the short agitation. This can be done with the drive arrangement of FIG. 5A or 8. Again, the arrangement of FIG. 8 is advantageous in the vibration aspect. Particularly, the scheme shown in FIG. 8 allows all of the four chambers to be driven at the same time.

The agitation in the chambers not located at the developing position should preferably be effected at a high speed in order to enhance the efficiency. Specifically, when the gear 81*a* is added, as shown in FIG. 5A, it may be rotated at a higher speed than the drive gear 81 assigned to the developing position. When the intermediate gears 95*a* are used, as shown in FIG. 8, the gear ratio of the gears 95*a* may be selected such that the screws in the chambers not located at the developing position rotate at a higher speed than the screws in the chamber located at the developing position. It is to be noted that the agitation speed available in the chamber at the developing position is limited in relation to the developing characteristic.

In summary, it will be seen that the present invention provides a revolver having various unprecedented advantages, as enumerated below.

(1) When the opening of a guide member faces downward during the rotation of a developing unit, a developer accumulated in the guide member is released via the opening evenly in the widthwise direction, i.e., without concentrating at a particular position, and then agitated in the vertical direction. Therefore, the vertical agitation can be effected without increasing the load on horizontal agitation to be effected in a developing chamber later.

(2) The developer from a developer receptacle is conveyed in a hollow member while being efficiently agitated and then released into the chamber via outlets formed in the hollow member. This part of the developer is immediately mixed and agitated with the developer existing in the chamber by blades. Hence, the developer to be transferred from the receptacle to the chamber can be charged more efficiently than in the conventional arrangements.

(3) The outlets of the hollow member are distributed only in a preselected range in order to increase the agitating time in the hollow member. This charges the developer more desirably.

(4) Part of developer conveying means extending out from at least one chamber and received in a receptacle is located at a position around which the developer exists. Hence, despite that the revolver is of the type rotating the developing unit, developer storing unit and conveying means integrally about a single axis, and causing the distribution of the developer in the containers to change, it is capable of replenishing the developer into the chamber located at a position other than the developing position.

(5) A torque is transmitted to at least one chamber not located at the developing position by drive transmitting means which transfers a torque input to the developing unit. Hence, the developer in the chamber not located at the developing position can be agitated without aggravating the vibration of the revolver.

(6) For the chamber located at the developing position and whose speed is limited for image quality reasons, the agitation speed is maintained relatively low to implement desirable development. For the other chambers free from the limitation, the agitation is effected at a relatively high speed to mix and agitate the developer sufficiently. As a result, the developers in such chambers are sufficiently agitated and then brought to the developing position to effect desirable development.

Various modifications will become possible for those skilled in the art after receiving the teachings of the present disclosure without departing from the scope thereof.

What is claimed is:

1. A rotary developing device, which comprises:

a developing unit having a plurality of developing chambers arranged around an axis of rotation wherein said developing unit is rotatable about said axis to move any one of said plurality of developing chambers to a developing position where an image carrier is located, said plurality of developing chambers each comprising:

a developer carrier;

a regulating member regulating an amount of a developer deposited on and being conveyed by said developer carrier toward the developing position;

a guide member having an opening formed therein, said opening extending parallel to a longitudinal axis of said guide member and receiving the developer removed from said developer carrier by said regulating member; and conveying means conveying the developer received by said guide member along said guide member wherein said conveying means is rotatable in such a direction that the developer is caused to drop through the opening of the guide member onto said conveying means wherein said conveying means is movable in the same direction as the developer upon being removed from said developer carrier by said regulating member.

2. A rotary developing device as claimed in claim 1, wherein said developing unit includes a toner receptacle and wherein a rotatable hollow member is disposed in each of said plurality of developing chambers and is formed with a plurality of agitating blades, said conveying means extending in said hollow member and said hollow member including an integral screw member to rotate therewith, said hollow member being formed with outlets in a circumferential wall portion thereof, said outlets being confined so as to be in a range of from an intermediate portion to a downstream end of said circumferential wall in a direction which the developer is conveyed so as to permit mixing of toner and developer within said rotatable hollow member and to permit frictional charging thereof prior to discharge through said outlets.

3. A rotary developing device as claimed in claim 1, wherein said guide member substantially completely surrounds said conveying means except for a partial opening formed therein for receiving the developer removed from said developer carrier by said regulating member.

4. A rotary developing device, which comprises:

a developing unit having a plurality of developing chambers arranged around an axis of rotation wherein said developing unit is rotatable about said axis to move any one of said plurality of developing chambers to a developing position where an image carrier is located, said plurality of developing chambers each comprising:

a developer carrier;

a regulating member regulating an amount of a developer deposited on and being conveyed by said developer carrier toward the developing position;

a guide member having an opening formed therein, said opening extending parallel to a longitudinal axis of said guide member and receiving the developer removed from said developer carrier by said regulating member; and a conveyor member conveying the developer received by said guide member along said guide member wherein said conveyor member is rotatable in such a direction that the developer is caused to drop through the opening of the guide member onto said conveyor member wherein said conveyor member is movable in the same direction as the developer upon being removed from said developer carrier by said regulating member.

5. A rotary developing device as claimed in claim 4, wherein said developing unit includes a toner receptacle and wherein a rotatable hollow member is disposed in each of said plurality of developing chambers and is formed with a plurality of agitating blades, said conveyor member extending in said hollow member and said hollow member including an integral screw member to rotate therewith, said hollow member being formed with outlets in a circumferential wall portion thereof, said outlets being confined so as to be only in a range of from an intermediate portion to a downstream end of said circumferential wall in a direction in which the developer is conveyed so as to permit mixing of toner with said rotatable hollow member and to permit frictional charging thereof prior to discharge through said outlets.

6. A rotary developing device as claimed in claim 4, wherein said guide member substantially completely surrounds said conveyor member except for a partial opening formed therein for receiving the developer removed from said developer carrier by said regulating member.

* * * * *